US005769536A

United States Patent [19]

Kotylak

[11] Patent Number: 5,769,536

[45] Date of Patent: Jun. 23, 1998

[54] MIXING CONTAINER FOR DISSOLVING DRY CHEMICALS IN WATER

[76] Inventor: Clayton Kotylak, P.O. Box 450, Montmartre Saskatchewan, Canada, S0G 3M0

[21] Appl. No.: 745,674

[22] Filed: Nov. 8, 1996

[51] Int. Cl.[6] ..... B01F 5/04

[52] U.S. Cl. ..... 366/136; 366/167.1

[58] Field of Search ..... 366/136, 137, 366/138, 159.1, 162.1, 167.1, 173.1, 173.2, 174.1, 175.2, 182.2, 182.4

[56] References Cited

U.S. PATENT DOCUMENTS

| | | | |
|---|---|---|---|
| 954,103 | 4/1910 | Irey | 366/137 X |
| 4,045,004 | 8/1977 | Berger | 366/137 |
| 4,084,796 | 4/1978 | Krehbiel | 366/137 |
| 4,475,818 | 10/1984 | Bialkowski | 366/137 X |
| 5,050,995 | 9/1991 | Lucore, II | 366/136 |
| 5,174,828 | 12/1992 | Roth . | |
| 5,609,417 | 3/1997 | Otte | 366/137 |

FOREIGN PATENT DOCUMENTS

| | | | |
|---|---|---|---|
| 550642 | 9/1956 | Belgium | 366/136 |

*Primary Examiner*—Charles E. Cooley
*Attorney, Agent, or Firm*—Adrian D. Battison; Murray Thrift

[57] ABSTRACT

Chemicals for a sprayer tank, particularly in dry dissolvable form, are mixed with water in a separate mixing container prior to adding to water in the sprayer tank. The mixing container has a hopper bottom with a perforated discharge control at the bottom apex for controlling the exit of mixed chemicals and water. An injection elbow is mounted on the hopper bottom for directing return water downwardly toward the apex for agitation of dry dissolvable chemicals collecting at the apex. Two valves are provided mounted on a common frame supporting the tank. The valves can be operated to control recirculation of water and dissolved chemicals back into the mixing tank and can be operated so that the same pump is used for filling the sprayer tank from a supply tank and for filling the mixing tank with mixing water for the chemicals.

15 Claims, 4 Drawing Sheets

MIXING CONTAINER FOR DISSOLVING DRY CHEMICALS IN WATER

BACKGROUND OF THE INVENTION

This invention relates a method and apparatus for mixing water and chemicals for example for supply to an agricultural sprayer.

In recent years it has been appreciated that the agricultural chemicals which are supplied for mixing with water for spraying over crops are significantly toxic when in concentrated condition. Attempts have been made therefore to reduce exposure by the farmer to the chemicals and to increase the safety of handling of those chemicals.

One example of an arrangement for use with liquid chemicals is shown in U.S. Pat. No. 5,174,828 (Roth) which discloses a discharge vessel which allows containers of the chemicals to be rapidly opened by slitting open the bottom of the container and for the chemicals to be extracted and washed away from the container by jets of water into the slit container. The above device is opposed particularly for liquid of such chemicals and while it could be used with dry dissolvable chemicals it is not particularly designed for this purpose.

Increased attention has been given recently to supplying such chemicals in dry dissolvable form since this is a safer condition which allows easier clean up of any spills. However it is of course necessary to effect mixing of the dry dissolvable chemicals with water so that the granular chemicals can be properly dissolved for spraying. Generally this is done in the sprayer tank where the chemicals are poured into the tank for agitation within the tank.

However any failure to properly mix the chemicals of course interferes with the proper concentration of the liquid as sprayed and also the dry dissolvable particles remaining in the liquid can regularly cause blockages in the sprayer nozzles thus again interfering with the proper spraying action.

SUMMARY OF THE INVENTION

It is one object of the present invention, therefore, to provide an improved method and apparatus for mixing particularly dry dissolvable chemicals for dissolving in water.

According to one aspect of the invention there is provided a method of filling an agricultural sprayer with a mixture of water and chemicals comprising:

providing a sprayer tank;

providing a supply of water for filling the sprayer tank;

providing the chemicals in one or more separate supply containers for mixing with the water;

providing a separate mixing tank having a liquid inlet, a liquid outlet adjacent a bottom of the mixing tank and an opening at a top wall of the mixing tank into which the chemicals from the container can be discharged from the container;

providing a pump for moving the water;

placing the chemicals through the opening into the separate mixing tank;

pumping water into the separate mixing tank;

mixing the water with the chemicals to cause the chemicals to dissolve into the water;

causing the pump to extract water with dissolved chemicals therein from the liquid outlet and to return the water with dissolved chemicals therein to the liquid inlet so as to recirculate the water with dissolved chemicals therein through the separate mixing tank until the chemicals are fully dissolved; and extracting the mixed water and dissolve the chemicals from the separate mixing tank for supply to the sprayer tank.

Preferably the method includes:

providing a first inlet valve having a first inlet and a second inlet and an outlet and being operable for selecting one of said first and second inlets for supplying liquid to the outlet and a second outlet valve having a first outlet and a second outlet and an inlet and being operable for selecting one of said first and second outlets for supplying liquid to the selected outlet from the inlet;

connecting the supply to the first inlet of the inlet valve;

connecting the liquid outlet of the mixing tank to the second inlet of the inlet valve;

connecting the outlet of the inlet valve to an intake of the pump;

connecting an output from the pump to the inlet of the outlet valve;

connecting the first outlet of the outlet valve to the inlet of the mixing tank;

and connecting the second outlet of the outlet valve to the sprayer tank.

Preferably the mixing tank is mounted on a frame and wherein the frame provides support means for supporting the inlet and outlet valves.

Preferably the frame, the mixing tank and the valves are portable as a common unit.

Preferably the frame includes a vertical post arranged at one side of the mixing tank and wherein the valves are mounted on the vertical post.

Preferably the liquid inlet of the mixing tank includes a directional element on an inside surface of the mixing tank, the directional element being arranged at a position spaced from the bottom of the tank and arranged to direct the liquid downwardly toward the bottom of the tank.

Preferably the tank includes a conical bottom and wherein the directional element is arranged on the conical bottom at a position spaced from a bottom apex thereof.

Preferably the liquid outlet of the mixing tank has an outlet control member thereon which is perforated so as to allow exit of water while preventing escape of dry dissolvable chemicals.

Preferably the outlet control member has an upper surface which is shaped so as to shed dry dissolvable chemical material falling onto the top surface.

Preferably the outlet control member comprises an upper horizontal cylindrical body and a vertical cylindrical body connected to an underside of the upper cylindrical body and extending downwardly therefrom to an outlet opening at the bottom of the tank.

Preferably the horizontal body includes perforated ends.

Preferably the vertical body includes a plurality of perforations on a peripheral surface thereof.

Preferably the method includes providing a water supply hose at one side of the mixing tank, an operable valve for controlling supply of water to the supply hose for rinsing the separate container and a support stand for supporting the separate container underneath the supply hose.

Preferably the operable valve is operable by a foot pedal.

According to a second aspect of the invention there is provided a mixing container comprising:

a mixing tank having a liquid inlet, a liquid outlet adjacent a bottom of the mixing tank and an opening at a top wall of the mixing tank into which the chemicals from the container can be discharged from the container;

a first inlet valve having a first inlet and a second inlet and an outlet and being operable for selecting one of said first and second inlets for supplying liquid to the outlet;

a second outlet valve having a first outlet and a second outlet and an inlet and being operable for selecting one of said first and second outlets for supplying liquid to the selected outlet from the inlet;

means for connecting the liquid outlet of the mixing tank to the second inlet of the inlet valve;

means for connecting the first outlet of the outlet valve to the inlet of the mixing tank;

and a frame for supporting the tank and the inlet and outlet valves;

wherein the frame, the mixing tank and the valves are portable as a common unit.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
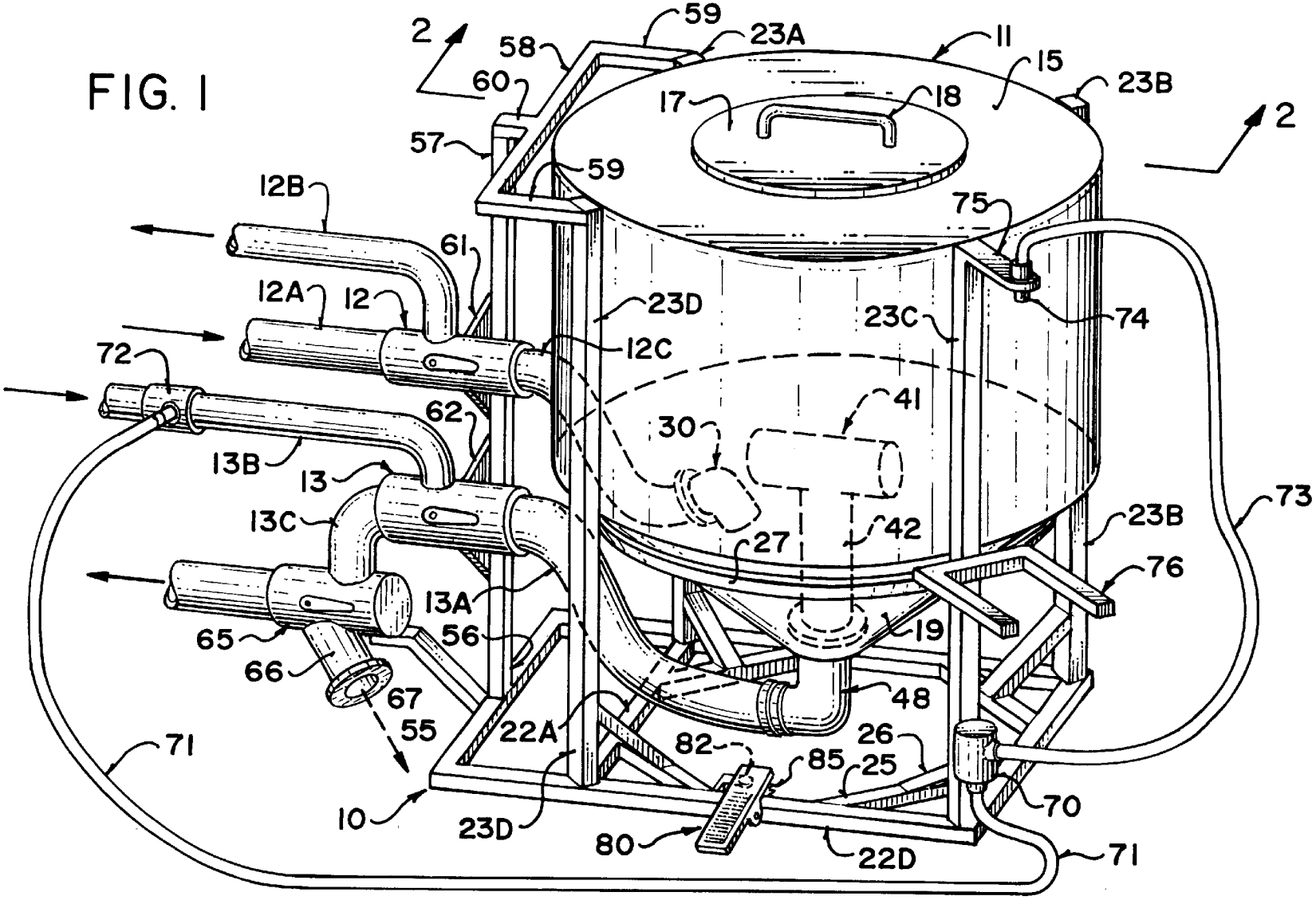
FIG. 1 is an isometric view of the apparatus according to the present invention.
Figure 2:
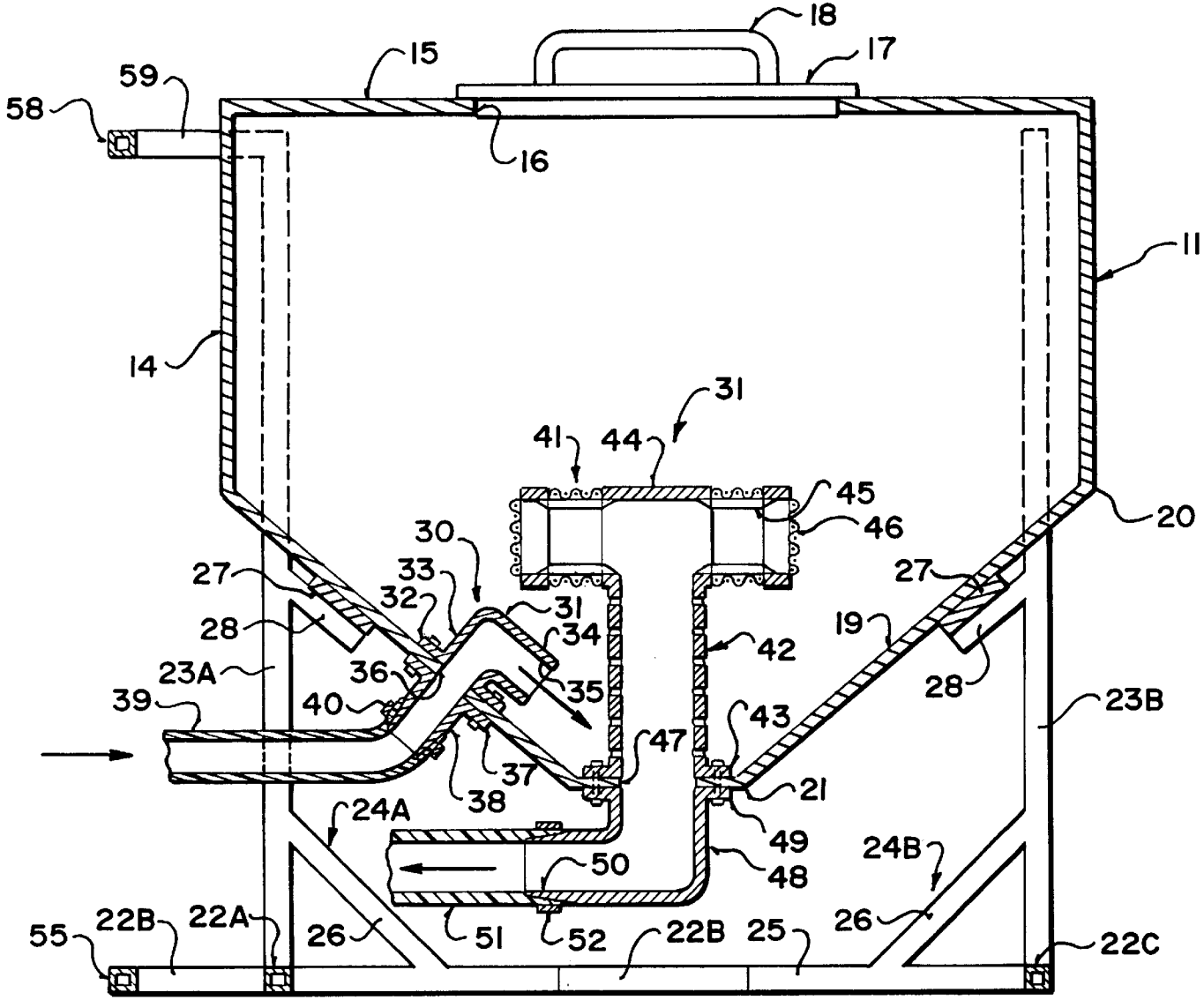
FIG. 2 is a vertical cross sectional view along the lines 2—2 of FIG. 1.
Figure 3:
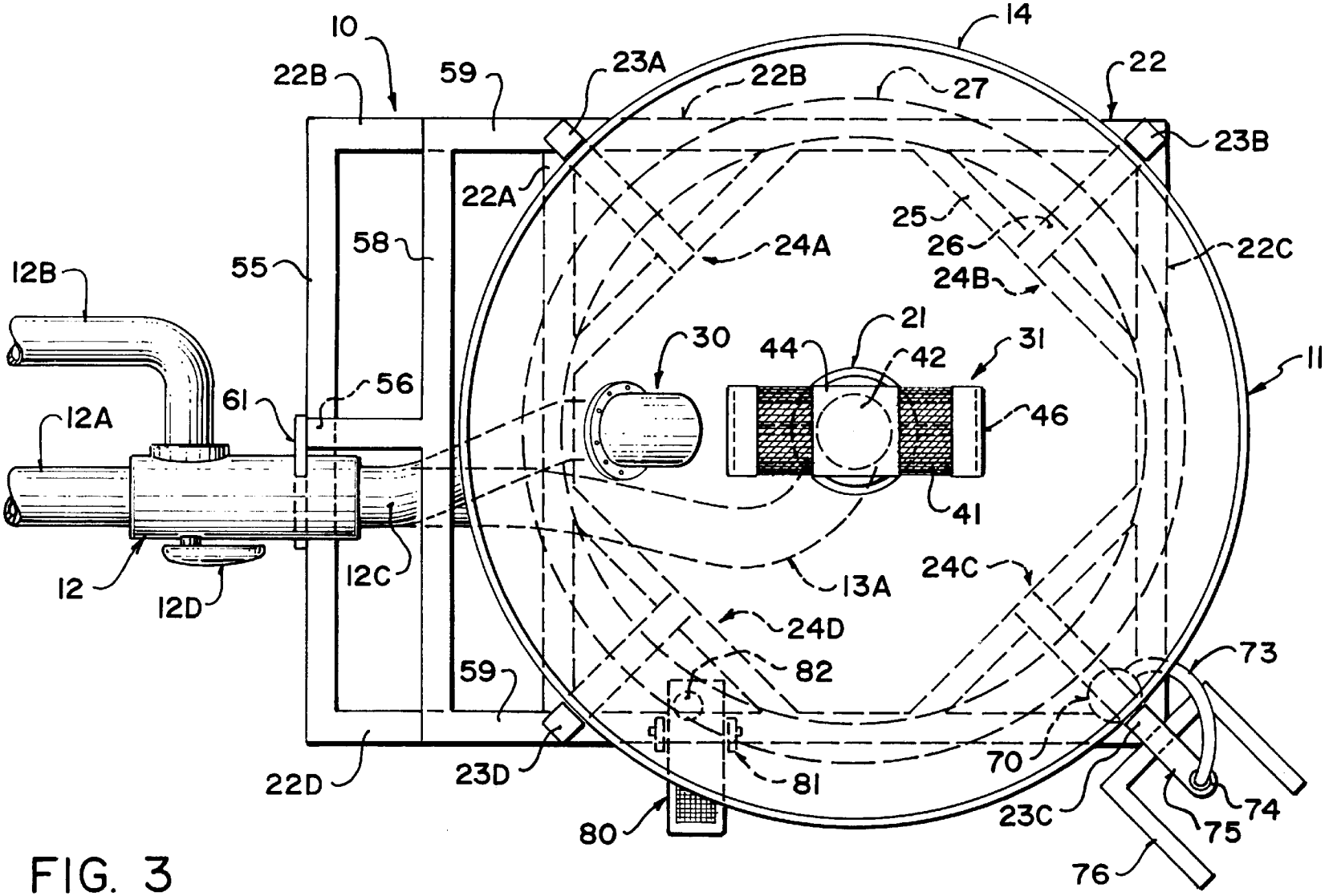
FIG. 3 is a top plan view of the apparatus of FIG. 1.

The apparatus of the present invention best shown in FIGS. 1, 2 and 3 comprises a frame generally indicated at 10 carrying a cylindrical tank 11, a first valve 12 and a second valve 13.

The tank 10 is generally cylindrical so as to form a cylindrical peripheral wall 14 with a horizontal top wall 15. A circular central opening 16 is provided in the top wall 15 through which chemicals to be mixed can be fed. A cover 17 is shaped so as to fit into the opening to provide a complete closure for the container 11, the cover 17 having a handle 18 by which it can be manually lifted to expose the opening 16.

For convenience of illustration, the top wall 15 is removed from FIG. 3.

The container has a conical bottom wall 19 extending inwardly and downwardly from a top edge 20 connected to a bottom edge of the cylindrical wall 14 and extending downwardly to a bottom apex 21 which is circular and horizontal. The container 11 is supported in the frame 10 so that it is carried at a position such that the apex 21 is spaced upwardly from the ground on which the frame 10 stands.

The frame 10 includes a horizontal base portion 22 defined by four rails 22A, 22B, 22C and 22D which are connected together at right angles to form generally a square structure having four corners. The size of the square and thus the length of the rails is arranged so that the four corners are aligned with the wall 14. At each corner is located a respective one of four vertical posts 23A, 23B, 23C and 23D. The posts are braced by a respective bracing element 24A, 24B, 24C and 24D. Each bracing element comprises a first rail 25 which lies in the horizontal bottom plane and is connected across the corner in diagonal arrangement and a second rail 26 which is inclined upwardly and outwardly from a centre of the rail 25 to a position part way up the respective post.

The posts carry a support ring 27 which is shaped so that it follows the conical wall 19 and underlies a portion of the wall 19 so as to support the wall 19 and thus the tank 11. The ring 27 is supported by four inclined hangers 28 each of which is associated with a respective one of the posts and extends from an inside part of the post downwardly along the underside of a ring and is attached to the ring for supporting the ring relative to the post.

The container thus can be simply dropped into place inside the posts 23 with the conical bottom wall 19 sitting on the ring 27 so that the weight from the tank and the liquid inside the tank is transferred to the frame.

In addition to the opening 16, the tank also includes a liquid inlet 30 and a liquid outlet 31. The liquid inlet 30 comprises an elbow 31 having a base flange 32 on an inside surface of the conical wall 19, an upstanding collar portion 33 and water direction control portion 34 arranged at right angles to the collar portion 33. Thus the water direction portions 34 defines a water outlet 35 which is at right angles to the direction of water inlet through the wall 19 at an opening 36. The direction of the opening 35 is arranged so that it directs down the wall 19 toward the apex 21. The opening 35 is spaced from the apex part way up the wall 19. The flange 32 is attached to a flange 37 of a coupling 38 mounted on the outside of the wall 19 so that the flanges 32 and 37 when clamped together seal the opening 36. The coupling 38 has a connector portion at the end opposite the flange 37 for receiving a hose 39 attached to the connector 38 by a band 40.

The water outlet control member 31 comprises an upper cylindrical portion 41 forming a cylinder with a horizontal axis and a lower vertical cylindrical portion 42 which extends downwardly from an underside of the horizontal upper portion 41 for connection at the apex 21 by a flange 43.

The horizontal upper cylindrical portion 41 is formed of a central T-piece 44 and a frame structure 45 extending outwardly from each of the T-piece. Around the frame 45 is provided a fabric mesh 46 having perforations of a dimension to allow the ready passage of water and dissolve the materials while preventing the passage of undissolved dry dissolvable materials supplied through the opening 16.

The cylindrical portion 41 thus has an arched upper surface when viewed in side elevation which acts to shed the dry dissolvable material poured through the opening 16 so that the dry dissolvable material does not sit on top of the discharge control member 31 but instead falls from it to the wall 19 and particularly toward the apex 21.

The vertical cylindrical portion 32 also has a series of perforations to allow the entry of water while preventing the passage of the dry dissolvable material. The vertical cylindrical portion 42 can be formed from a solid cylindrical member with cut slots around the periphery or it can be formed from a similar frame structure with covering perforated fabric as used for the horizontal cylindrical member 41.

At the apex 21 is provided an opening 47 through which water entering the discharge control member 31 can pass. The flange 43 is clamped around the opening by a coupling 48 on the outside of the apex 21. The coupling having a similar flange 49 bolted to the flange 43. The coupling 48 has a connector element 50 at its opposed end for receiving the end of a hose 51 clamped to the coupling 50 by a band 52.

As best shown in FIGS. 1 and 3, the rails 22B and 22D extend beyond the rail 22A and connect to a further horizontal cross rail 55 lying in the common horizontal base plane and parallel to the rail 22A. A fifth post 56 parallel to the posts 23 stands vertically upwardly from the rail 55 to an upper end 57. The post 56 is spaced partly along the rail 55 but is closer to the rail 22D than the rail 22B.

The posts 23A and 23D are connected by a horizontal rail 58 which extends parallel to the rail 55 and spaced upwardly therefrom. The rail 58 is connected to each of the posts 23A and 23D by a horizontal coupling portion 59 at right angles to the rail 58. The upper end 57 of the post 56 is connected to the rail 58 by a coupling portion 60. These connecting arrangements provide a rigid support for the vertical post 56 which thus acts as a support for the valves 12 and 13.

Thus the post 56 carries a pair of brackets 61 and 62 each of which projects outwardly to one side of the post toward the rail 22D with each bracket carrying a respective one of the valves 12 and 13.

The valve 12 comprises an inlet valve having a first inlet 12A, a first outlet 12B and a second outlet 12C. The valve is operable by a manually operable lever 12D so as to switch outlet so that the liquid from the inlet 12A can be supplied either to the outlet 12B or the outlet 12C depending on the position of the lever.

The valve 13 is an outlet valve and includes a first inlet 13A, a second inlet 13B and an outlet 13C. The valve can be manually switched by a lever 13D to select one of the inlets 13A for supply of liquid to the outlet 13C. The outlet 13C is connected to a Y-fitting 65 with a drain plug 66 for draining the system when required. Additional support for the Y-fitting 65 is provided by a bracket 67 which extends from the rail 55 upwardly to an underside of the Y fitting 65.

A small electrically operated pump 70 is mounted on one of the posts 23. An inlet line 71 to the pump 70 connects to a T fitting 72 at the inlet 13B. An outlet line 73 from the pump extends to a nozzle 74 carried on a bracket 75 projecting outwardly from the top of the post 23C. Underneath the nozzle 74 is provided a support bracket 76 which is carried on the post 23C at a height such that the container 77 can be received on the bracket 76 and supported thereby while the container is filled with water from the nozzle 74. The bracket 76 thus comprises a pair of parallel arms connected by a horizontal rail attached to the post 23C.

A foot operated switch 80 is mounted on the rail 22D for horizontal pivotal movement about mounting bracket 81 when pressed downwardly by a foot of the user. The foot switch 80 operates a switch element 82 which is electrically connected as schematically indicated at 84 to an electrical pump 70. The foot switch is biased by a spring 85 to a position in which the pump is switched off. Depression of the foot switch by the foot of the user actuates the switch element 82 to operate the pump while the foot switch is depressed.

Figure 4:
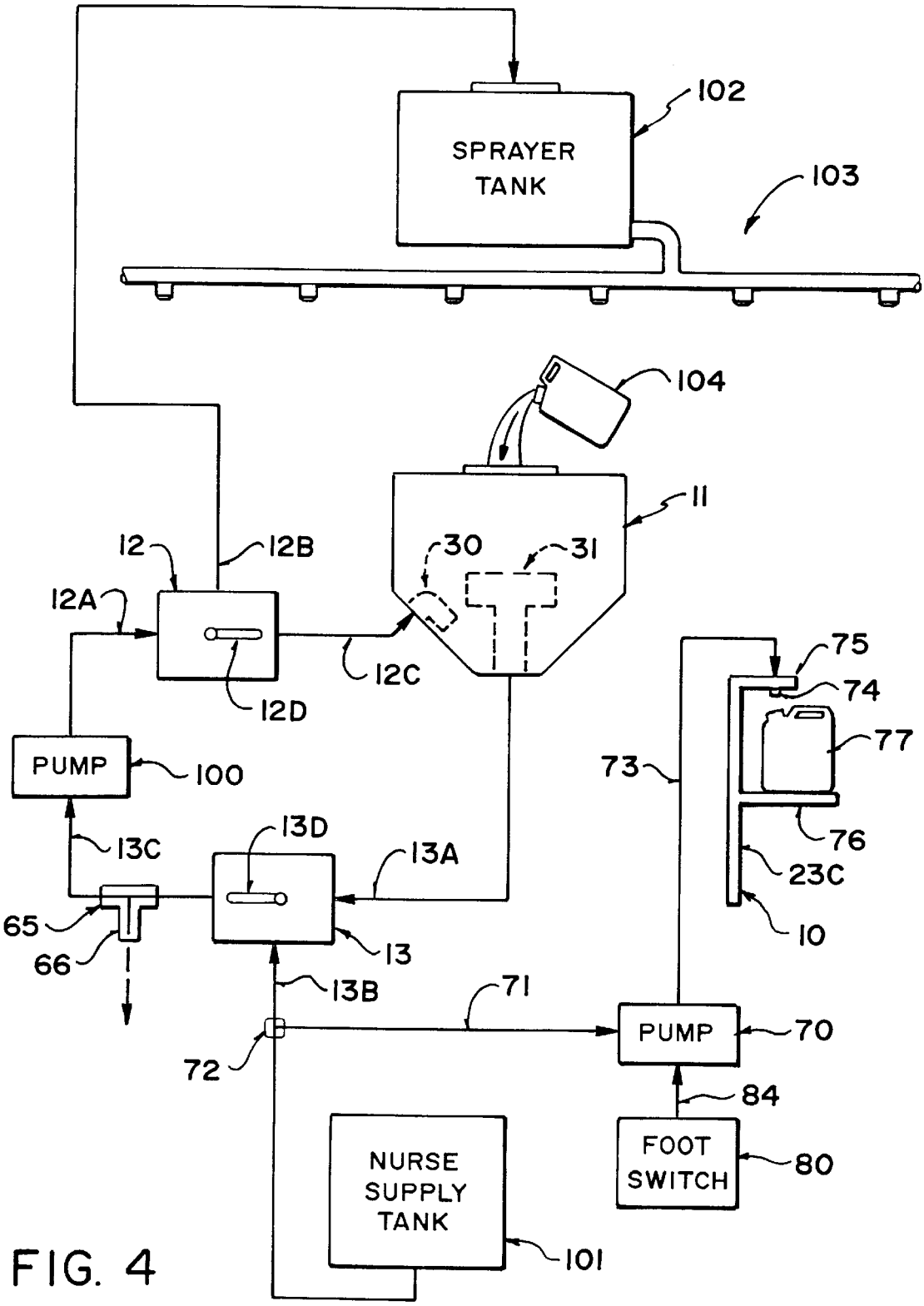
FIG. 4 is a schematic illustration of the apparatus in conjunction with a nurse or water supply tank, a pump for that tank and a sprayer tank to be filled with the mixed chemicals.

As shown in FIG. 4, the apparatus as described above is used in conjunction with a pump 100 and a nurse or supply tank 101 for filling a tank 102 of a sprayer 103.

Thus a feed line from the tank 101 is connected to the inlet 13B of the valve 13. A feed line for filling the sprayer tank 102 is connected to the outlet 12B of the valve 12. The pump 100 is connected to the outlet 13C of the valve 13 and the inlet 12A of the valve 12. The outlet 12C of the valve 12 is connected to the inlet 30 of the mixing tank 11. The outlet 31 of the mixing tank 11 is connected to the inlet 13A of the valve 13.

In operation the valve 13 is operated so that the inlet 13B is connected to the outlet 13C allowing water to be pumped by the pump 100 from the valve 12 to the outlet 12C and thus into the mixing tank 11.

Either prior to, subsequent to or simultaneously with the filling of the tank 11 with water, chemicals from a supply container 104 are poured into the mixing container through the top opening.

When the tank is filled with water and sufficient quantity of the chemicals 104, which may require one or more of the containers, the valve 13 is switched to the opposite position so that water is drawn from the inlet 13A and fed to the pump so that the water is drawn from the mixing tank 11 through the discharge 31 and is fed back into the mixing tank in a recirculation process through the direction control element 30. The water is jetted to the bottom of the mixing container 11 so that the chemicals collecting at the bottom of the container are circulated and agitated by the movement of the water from the direction control element 30. The conical hopper walls tend to collect the dry dissolvable material at the bottom of the hopper bottom adjacent to the apex 21. The shape of the hopper cooperates with the injection of the water through the directional control element to cause agitation of the dry dissolvable materials. The agitation effects the dissolving of the dry dissolvable chemicals in the water. The perforations in the outlet control member 31 allow water and dissolved chemicals to escape but prevent the dry dissolvable materials from escaping from the container until they are fully dissolved. The recirculation therefore effects full dissolution of the dry dissolvable chemicals in the water in a relatively quick period of time.

When the dissolving is complete, the valve 12 is operated so that the material from the pump passes to the outlet 12B for filling the sprayer tank 102. Thus when fully mixed, the mixed water and chemicals is fed to the sprayer tank 102 for entry to the sprayer tank. The mixed materials are then supplemented with additional water from the tank 101 by switching the valve 13 so that the pump feeds directly from the tank 101 to the sprayer tank 102 without going to or through the mixing tank 11.

If the container 104 needs to be rinsed, particularly if the chemicals are in liquid form, while the mixing tank 11 is being filled with water from the supply tank 101, the foot switch 80 is actuated so that the pump 70 draws water from the supply line thus directing water through the nozzle 74 into the container while it is supported on the rack 76 so that the container can be rinsed and the mixed chemicals and rinsing water poured back into the mixing container 11.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of filling an agricultural sprayer with a mixture of water and chemicals comprising:

providing a sprayer tank;

providing a supply of water for filling the sprayer tank;

providing the chemicals in one or more separate supply containers for mixing with the water;

providing a separate mixing tank having a liquid inlet, a liquid outlet adjacent a bottom of the mixing tank and an opening at a top wall of the mixing tank into which the chemicals from said one or more containers can be discharged from the container;

providing a pump for moving the water;

providing a first inlet valve having a first inlet and a second inlet and an outlet and being operable for selecting one of said first and second inlets for supplying liquid to the outlet and a second outlet valve having a first outlet and a second outlet and an inlet and being operable for selecting one of said first and second outlets for supplying liquid to the selected outlet from the inlet;

connecting the supply of water to the first inlet of the inlet valve;

connecting the liquid outlet of the mixing tank to the second inlet of the inlet valve;

connecting the outlet of the inlet valve to an intake of the pump;

connecting an output from the pump to the inlet of the outlet valve;

connecting the first outlet of the outlet valve to the inlet of the mixing tank;

connecting the second outlet of the outlet valve to the spray tank placing the chemicals through the opening into the separate mixing tank;

operating the inlet and outlet valves so as to pump water from the supply of water through the first inlet and through the outlet of the inlet valve, through the pump and through the inlet and through the first outlet of the outlet valve into the separate mixing tank;

mixing the water with the chemicals to cause the chemicals to dissolve into the water;

operating the inlet and outlet valves so as to cause the pump to extract water with dissolved chemicals therein from the liquid outlet through the second inlet and through the outlet of the inlet valve, through the pump and through the inlet and through the first outlet of the outlet valve and to return the water with dissolved chemicals therein to the liquid inlet so as to recirculate the water with dissolved chemicals therein through the separate mixing tank until the chemicals are fully dissolved; and operating the inlet and outlet valves to extract the mixed water and dissolved chemicals from the separate mixing tank through the second inlet and through the outlet of the inlet valve, through the pump and through the inlet and through the second outlet of the outlet valve so as to supply the water and dissolved chemicals to the sprayer tank.

2. The method according to claim 1 including providing for the mixing tank a conical bottom converging to a bottom apex and including providing on the liquid inlet of the mixing tank a directional element mounted on an inside surface of the conical bottom at a position spaced from the bottom apex, and arranging the directional element at a position spaced from the bottom apex of the tank so as to direct the liquid downwardly toward the bottom apex of the tank.

3. The method according to claim 1 including providing a water supply hose at one side of the mixing tank, an operable valve for controlling supply of water to the supply hose for rinsing the one or more separate supply containers and a support stand for supporting the one or more separate supply containers underneath the supply hose.

4. The method according to claim 3 including operating the operable valve by a foot pedal.

5. The method according to claim 1 including providing on the liquid outlet of the mixing tank an outlet control member comprising:

a vertical cylindrical duct connected to the liquid outlet and standing upwardly therefrom for allowing discharge of liquid from the mixing tank;

a top portion mounted on a top end of the cylindrical duct and projecting outwardly to sides of the cylindrical duct;

the cylindrical duct and the top portion both being formed of a perforated screen so as to allow exit of water while preventing escape of dry dissolvable chemicals;

and an upper surface of the top portion which is shaped so as to shed dry dissolvable chemical material falling onto the top surface.

6. The method according to claim 5 including providing the top portion in the form of a horizontal perforated cylindrical body including perforated ends.

7. A mixing container for receiving and mixing chemicals from a supply container comprising:

a mixing tank having a conical bottom converging to a lowermost apex, a liquid inlet, a liquid outlet at the lowermost apex of the mixing tank and an opening at a top wall of the mixing tank into which the chemicals from the supply container can be discharged from the supply container;

a first inlet valve having a first inlet and a second inlet and an outlet and being operable for selecting one of said first and second inlets for supplying liquid to the outlet;

a second outlet valve having a first outlet and a second outlet and an inlet and being operable for selecting one of said first and second outlets for supplying liquid to the selected outlet from the inlet;

means for connecting the liquid outlet of the mixing tank to the second inlet of the inlet valve;

and means for connecting the first outlet of the outlet valve to the inlet of the mixing tank;

wherein the liquid inlet of the mixing tank includes a directional element on an inside surface of the mixing tank, the directional element being arranged on the conical bottom of the tank and arranged to direct the liquid downwardly toward the lowermost apex of the tank.

8. The container according to claim 7 including a frame for supporting the tank and the inlet and outlet wherein the frame, the mixing tank and the valves are portable as a common unit.

9. The container according to claim 8 wherein the frame includes a vertical post arranged at one side of the mixing tank and wherein the valves are mounted on the vertical post.

10. The container according to claim 7 wherein the liquid outlet of the mixing tank has an outlet control member thereon comprising:

a vertical cylindrical duct connected to the liquid outlet and standing upwardly therefrom for allowing discharge of liquid from the mixing tank;

a top portion mounted on a top end of the cylindrical duct and projecting outwardly to sides of the cylindrical duct;

the cylindrical duct and the top portion both being formed of a perforated screen so as to allow exit of water while preventing escape of dry dissolvable chemicals;

and an upper surface of the top portion which is shaped so as to shed dry dissolvable chemical material falling onto the top surface.

11. The container according to claim 10 wherein the top portion comprises a horizontal cylindrical body having perforated ends and wherein the vertical cylindrical duct includes a plurality of perforations on a peripheral surface thereof.

12. The container according to claim 7 including a water supply hose at one side of the mixing tank, an operable valve for controlling supply of water to the supply hose for rinsing the supply container and a support stand for supporting the separate container underneath the supply hose.

13. The container according to claim 12 wherein the operable valve is operable by a foot pedal.

14. A mixing container for receiving and mixing chemicals from a supply container comprising:

a mixing tank having a conical bottom converging to a lowermost apex, a liquid inlet, a liquid outlet at the lowermost apex of the mixing tank and an opening at a top wall of the mixing tank into which the chemicals from the supply container can be discharged from the supply container;

a first inlet valve having a first inlet and a second inlet and an outlet and being operable for selecting one of said first and second inlets for supplying liquid to the outlet;

a second outlet valve having a first outlet and a second outlet and an inlet and being operable for selecting one of said first and second outlets for supplying liquid to the selected outlet from the inlet;

means for connecting the liquid outlet of the mixing tank to the second inlet of the inlet valve;

and means for connecting the first outlet of the outlet valve to the inlet of the mixing tank;

wherein the liquid outlet of the mixing tank has an outlet control member thereon comprising:

a vertical cylindrical duct connected to the liquid outlet and standing upwardly therefrom for allowing discharge of liquid from the mixing tank;

a top portion mounted on a top end of the cylindrical duct and projecting outwardly to sides of the cylindrical duct;

the cylindrical duct and the top portion both being formed of a perforated screen so as to allow exit of water while preventing escape of dry dissolvable chemicals;

and an upper surface of the top portion which is shaped so as to shed dry dissolvable chemical material falling onto the top surface.

15. The method according to claim 14 wherein the top portion comprises a horizontal cylindrical body having perforated ends and wherein the vertical cylindrical duct includes a plurality of perforations on a peripheral surface thereof.

* * * * *